US012697002B2

(12) United States Patent
Lewis

(10) Patent No.: US 12,697,002 B2
(45) Date of Patent: Aug. 4, 2026

(54) DISPENSING DEVICE WITH RESTRICTED TOWEL DISPENSER

(71) Applicant: Kimberly-Clark Worldwide, Inc., Neenah, WI (US)

(72) Inventor: Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 483 days.

(21) Appl. No.: 17/920,091

(22) PCT Filed: May 27, 2020

(86) PCT No.: PCT/US2020/034695

§ 371 (c)(1),
(2) Date: Oct. 20, 2022

(87) PCT Pub. No.: WO2021/242233

PCT Pub. Date: Dec. 2, 2021

(65) Prior Publication Data

US 2023/0157491 A1 May 25, 2023

(51) Int. Cl.
*A47K 10/38* (2006.01)
*A47K 10/36* (2006.01)

(52) U.S. Cl.
CPC ..... *A47K 10/38* (2013.01); *A47K 10/36* (2013.01)

(58) Field of Classification Search
CPC ..... A47K 10/34; A47K 10/36; A47K 10/38; A47K 2010/3675
USPC ..... 242/564.1
See application file for complete search history.

(56) References Cited

U.S. PATENT DOCUMENTS 1,553,170 A 9/1925 Leslie et al.
1,553,331 A 9/1925 Shelley
2,135,767 A * 11/1938 Price ..... A47K 10/36 312/34.19
2,279,135 A 4/1942 Engel
2,601,956 A * 7/1952 Birr ..... A47K 10/3656 242/564.4
2,830,810 A 4/1958 Colburn et al.
(Continued)

FOREIGN PATENT DOCUMENTS

CN 101026986 A 8/2007
CN 103068289 A 4/2013
(Continued)

OTHER PUBLICATIONS

International Search Report and Written Opinion for PCT/US2020/034695 dated Feb. 4, 2021, 10 pages.
(Continued)

*Primary Examiner* — William A. Rivera
(74) *Attorney, Agent, or Firm* — Dority & Manning, P.A.

(57) ABSTRACT

A dispenser for sheet materials is disclosed. The dispenser includes indexing mechanism and stop release member for dispensing a selected size of sheet material. The indexing mechanism includes an extension spring for dispensing a tail of sheet material from the dispenser. In embodiments, the dispenser includes a drive roller capable of rotating the indexing mechanism when a user removes the sheet material from the dispenser. The drive roller is prevented from rotating when the stop member engages stop release member.

20 Claims, 13 Drawing Sheets

(56) References Cited

U.S. PATENT DOCUMENTS

| | | | | |
|---|---|---|---|---|
| 3,512,678 | A * | 5/1970 | Beck | G07B 3/02 226/110 |
| 3,647,159 | A * | 3/1972 | Bump | A47K 10/3656 242/564.4 |
| 4,122,738 | A | 10/1978 | Granger | |
| 5,979,284 | A | 11/1999 | Granger | |
| 6,446,901 | B1 * | 9/2002 | Haen | B65H 35/006 242/564.1 |
| 6,715,637 | B1 | 4/2004 | Ramos | |
| 7,287,667 | B2 | 10/2007 | Brown et al. | |
| 7,637,190 | B2 * | 12/2009 | Granger | A47K 10/3637 83/337 |
| 8,733,218 | B2 | 5/2014 | Hansen et al. | |
| 9,854,948 | B1 | 1/2018 | Paal et al. | |
| 9,962,045 | B2 | 5/2018 | Granger | |
| 10,376,108 | B2 | 8/2019 | Morand | |
| 2008/0217350 | A1 | 9/2008 | Hansen et al. | |
| 2009/0230231 | A1 | 9/2009 | Kim | |
| 2017/0188759 | A1 | 7/2017 | Borke | |

FOREIGN PATENT DOCUMENTS

| | | | |
|---|---|---|---|
| DE | 2639810 | A1 | 3/1978 |
| JP | H09103389 | | 4/1997 |

OTHER PUBLICATIONS

Chinese Search Report Corresponding to Application No. 202080101146.9 on Jan. 24, 2025.

European Search Report Corresponding to Application No. 20938426.2 on Apr. 17, 2024.

Sahlberg, Optimization of Tissue Dispensers, Master of Science Thesis, Department of Product and Production Development, Chalmers University of Technology, Göteborg, Sweden, 2010, 67 pages.

* cited by examiner

DISPENSING DEVICE WITH RESTRICTED TOWEL DISPENSER

RELATED APPLICATIONS

The present application is the National Stage entry of International Patent Application No. PCT/US2020/034695, filed on May 27, 2020, which is incorporated herein by reference.

BACKGROUND

Washrooms in commercial and residential buildings typically include products such as toilet tissue or paper towels. These products are typically housed by a dispenser and are dispensed as needed by the user. Indeed, there are a number of manual, semi-automatic, and automatic dispensers capable of dispensing said products. The cost of dispensers can vary greatly depending on the complexity of the apparatus. For example, many semi-automatic and automatic dispensers include motorized parts for automatically dispensing material. Automatic dispensers can include sensors for automatically dispensing a portion of product when a user is within range of the dispenser. However, these motorized parts and sensors can significantly increase the cost of the dispenser. Similar to the semi-automatic or automatic dispensers, restrictive manual dispensers can be needlessly complex containing knives in drums with over molded materials and complex mechanisms. Non-restrictive manual dispensers allow users to take excessive amounts of product which is costly to the facility.

Additionally, certain dispensers can also require numerous parts housed within the dispenser, which can increase the cost of the dispenser. Such dispensers include several internal components that may breakdown more frequently, which causes the dispenser to be incapable of dispensing product. Breakdown of the dispenser is frustrating for restroom users given that no product is capable of being dispensed when the user accesses the dispenser. Further, breakdown of the internal components of the dispenser can require tedious repair or costly replacement by restroom maintenance personnel.

In view of the above, a need exists for a dispenser having an improved design that is functional and can be achieved at a reduced cost.

SUMMARY

In general, the present disclosure is directed to a dispenser for a sheet material, such as paper towels, that includes a drive roller, indexing mechanism, and stop release member capable of dispensing a selected size of sheet material. Further, the dispenser includes an extension spring configured to the indexing mechanism such that upon the user tearing the selected sized sheet of material, the dispenser is capable of dispensing a portion of sheet material so that the next user can easily access the sheet material.

In one embodiment, for instance, the present disclosure is directed to a dispenser for sheet material, such as paper towels, bath tissue, and the like. The dispenser includes a housing having an interior volume so as to retain at least one roll of sheet material. The dispenser further includes a dispensing mechanism contained within the housing for dispensing the sheet material.

In accordance with the present disclosure, dispensing mechanism includes a drive roller configured to an indexing mechanism. The indexing mechanism includes a spring attachment mechanism having an extension spring attached thereto. The dispensing mechanism also includes a stop release member having a first end associated with a tear member and a second end configured to engage a stop member configured to the indexing mechanism. The rotation of the drive roller and indexing mechanism is stopped upon the stop member engaging the second end of the stop release member. Tearing of the sheet material by the user moves the first end of the stop release member such that the second end of the stop release member disengages the stop member. Once the stop release member disengages the stop member, energy stored in the extension spring is capable of moving the indexing mechanism and the drive roller such that a portion of sheet material can be dispensed.

In one embodiment, the indexing mechanism includes a drive wheel configured to the drive roller and a driven wheel configured to the drive wheel. An extension spring is configured to the driven wheel. Removal of the sheet material from the dispenser by the user causes the drive roller to rotate, which in turn rotates the drive wheel, which rotates the driven wheel. Rotation of the drive roller, drive wheel, and driven wheel is stopped when a stop member configured to the driven wheel comes into engagement with a stop release member. Upon tearing of the dispensed sheet material by the user, the stop release member disengages from the stop member allowing energy stored in the extension spring to at least partially rotate the driven wheel, which rotates the drive wheel and the drive roller to dispense a portion of sheet material.

In embodiments, the dispenser can include an access opening configured to allow a user to access the sheet material. The access opening can include one or more tear members for tearing selected sizes of the sheet material from the roll.

In embodiments, the dispensing mechanism includes a pressure roller configured to the drive roller. The sheet material can be dispensed via a dispensing path that is formed between the drive roller and the pressure roller. The drive roller is rotated by the sheet material as the sheet material is moved along the dispensing path.

In embodiments, the stop member is attached to a disk that is configured to the indexing mechanism. For example, the disk can be configured to the driven wheel such that the stop member rotates in the same manner as the driven wheel.

In embodiments, stop release member is configured with a first end and a second end. The first end of the stop release member is configured such that in order for the sheet material to access the tear member(s) the sheet material comes into contact with the first end of the stop release member causing the stop release member to pivot about a pivot point and causing the second end of the stop release member to disengage from the stop member.

In addition to functionality, the dispenser provided herein can be manufactured at a lower cost as compared to other manual, semi-automatic, or automatic dispensers.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1A:
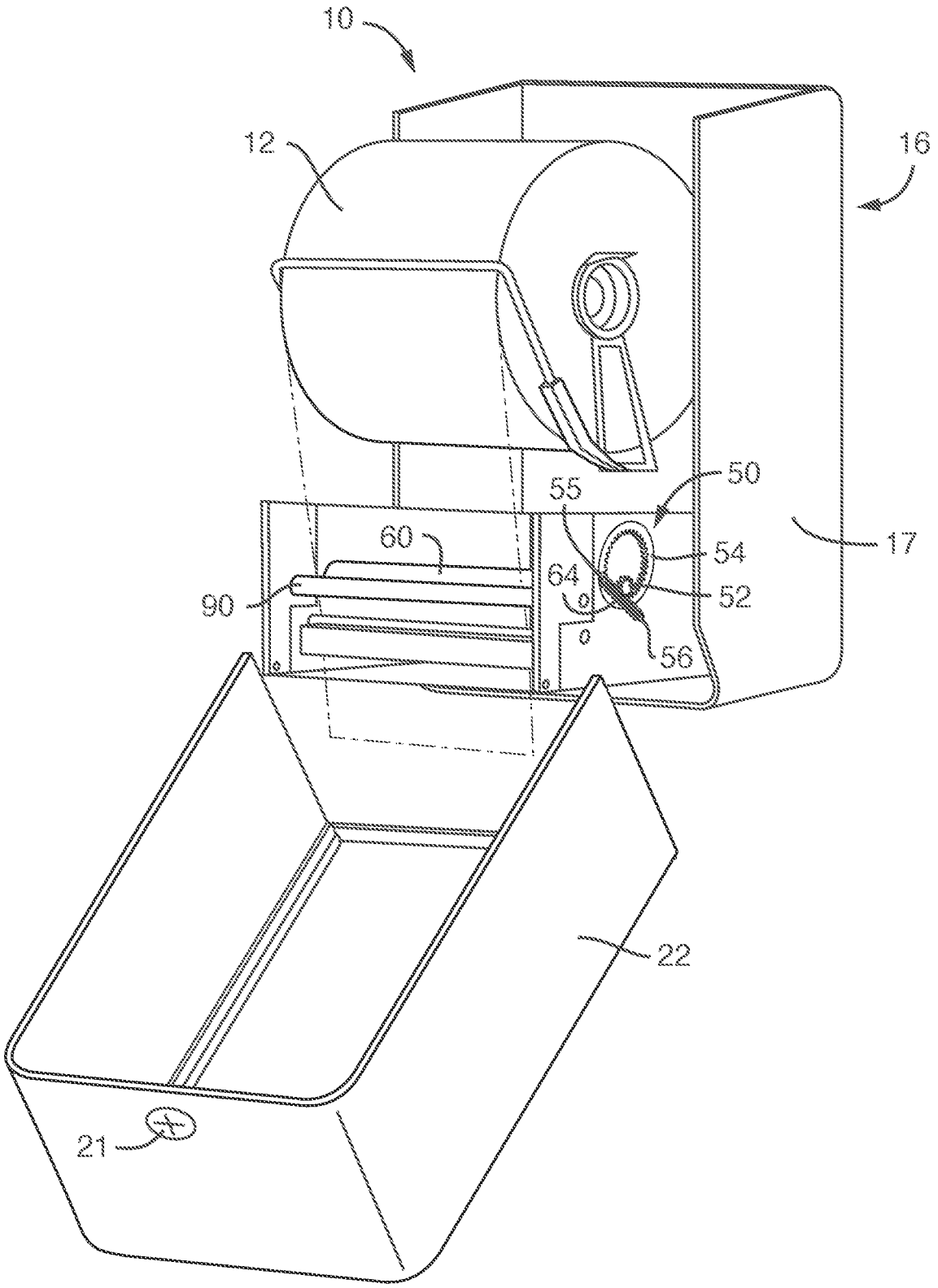
FIG. 1A is a perspective view of one embodiment of a dispenser in accordance with the present disclosure with its front cover in an open position.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for sheet materials and/or to a dispenser assembly. The dispenser of the present disclosure allows for the dispensing of a sheet material utilizing a dispensing mechanism that can be manufactured at lower costs as compared to other dispensers. More particularly, the present disclosure is directed to a dispenser for sheet materials with a dispensing mechanism capable of providing a portion of sheet material (a "tail") after each use of the dispenser. The tail of sheet material is capable of being dispensed without requiring any automated components. Thus, the dispenser is a "hands-free" dispenser capable of dispensing a tail without requiring the user to touch the components of the dispenser.

In one embodiment, the dispenser includes a dispensing mechanism having a drive roller, a indexing mechanism, an extension spring, and a stop release member. In one embodiment, the dispenser further includes a stop member configured to engage the stop release member. In certain embodiments, the indexing mechanism includes a drive wheel and a driven wheel. The driven wheel is configured to be attached to an extension spring, such that upon disengagement of the stop member from the stop release member, energy stored in the extension spring can rotate the driven wheel, which rotates the drive wheel and the drive roller to dispense a portion of sheet material, such as a tail.

Referring particularly to FIGS. 1 and 5-14, various embodiments of a dispenser 10 made according to the present disclosure are illustrated. As shown particularly in FIG. 1, the dispenser 10 includes a housing 16 that can have any desired overall shape. The housing 16 can include a backplate suitable for mounting to a surface and one or more sidewalls 17 extending from the back cover further defining the interior space of the housing. The dispenser 10 can include a front cover 22. The front cover 22 can be pivotally mounted to the housing 16 using any suitable means. For example, in one embodiment, hinges can be used to connect the front cover 22 with the housing 16. Alternatively, the front cover 22 can be completely separable from the housing 16. The front cover 22 is moveable from a closed position to an open position. The front cover 22 can define the front face and top of the dispenser 10, while the housing 16 can define the bottom and the sidewalls 17 of the dispenser 10. In the embodiment illustrated, the sidewalls 17 are entirely defined by the housing 16. In other embodiments, however, the front cover 22 may have sidewalls that cooperate with the sidewalls 17 of the housing 16. The housing 16 defines an interior volume for housing the operational components of the dispenser 10, as well as the roll or rolls of sheet material 12 to be dispensed, including a main roll. In embodiments, the interior volume of the housing 16 may be suitable for holding more than one roll of material. The dispenser 10 can also include any conventional locking mechanism 21 for securing the front cover 22 to the housing 16. The housing 16 further includes an opening through which a sheet material is dispensed.

The operational components of the dispenser 10 may be mounted directly to the housing 16 or can be part of a module or insert that is received within the housing 16. For example, the operational components can be part of a module that may be readily removable from the housing for servicing and/or replacing components without the necessity of having to remove the entire dispenser 10 from its support surface.

Figure 1B:
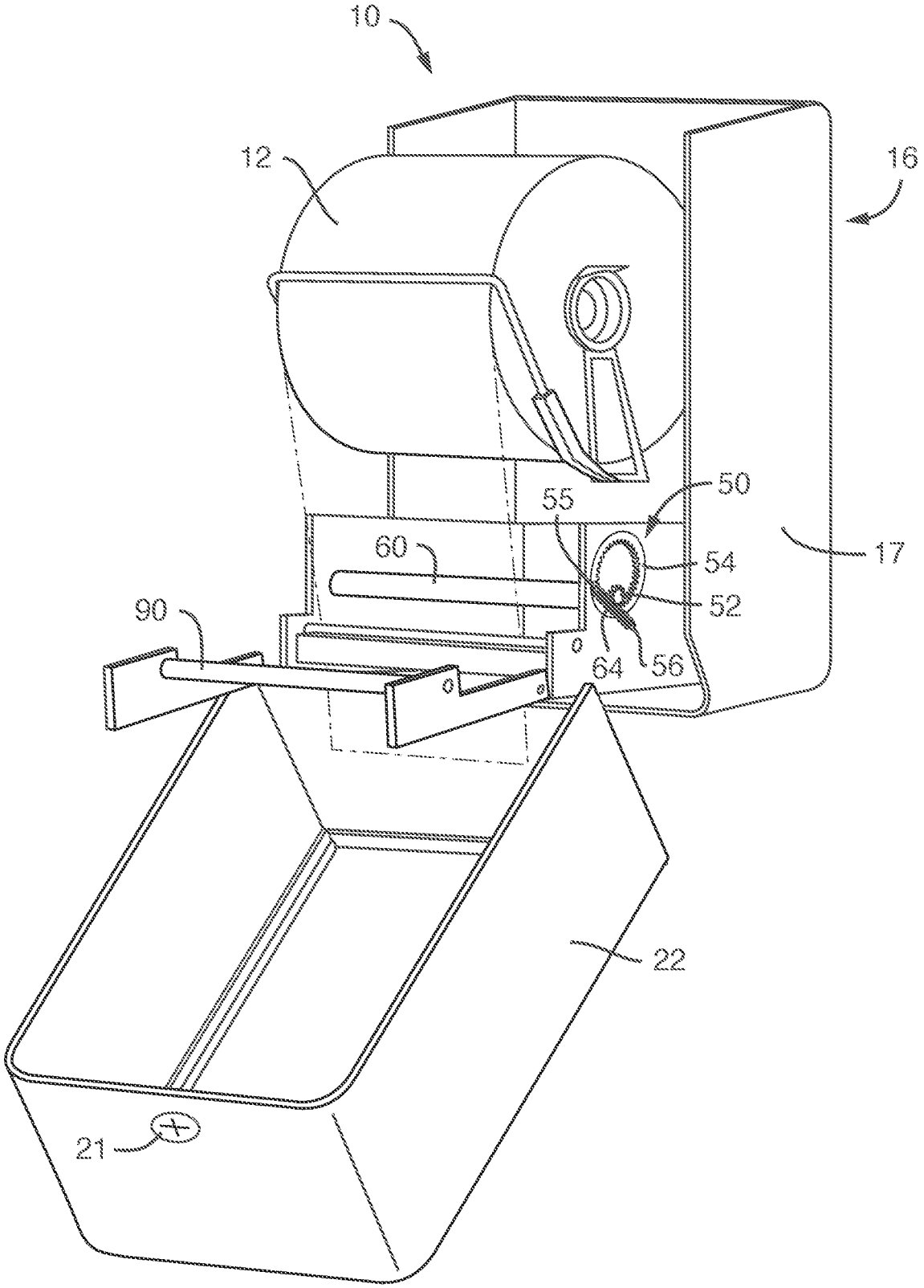
FIG. 1B is a perspective view of one embodiment of a dispenser in accordance with the present disclosure with its front cover in an open position

As shown in FIG. 1, the operational components of the dispenser 10 can include a indexing mechanism 50 and a drive roller 60. As used herein, the term "indexing mechanism" refers to any intermittent drive mechanism that turns a wheel or shaft a set amount and then stops for a set amount of time before turning the wheel or shaft again for a set amount. Any suitable indexing mechanism can be used herein including, but not limited to, Geneva mechanisms, such as an external Geneva mechanism, an internal Geneva mechanism, or a spherical Geneva mechanism, mutilated gears, cycloidal gears, star wheels, cams, internal gears and combinations thereof. As shown, the indexing mechanism 50 can include a drive wheel 52 configured to a drive roller 60 and a driven wheel 54 configured to the drive wheel 52. The drive wheel 52 is configured to the drive roller 60, such that as the sheet material 12 is dispensed along the dispensing path, the sheet material 12 rotates the drive roller 60, which in turn rotates the drive wheel 52 and the driven wheel 54 of the indexing mechanism 50. The driven wheel 54 can be configured to a stop member 70. The stop member 70 is configured to the driven wheel 54, such that the stop member 70 rotates in the same manner as the driven wheel 54. A stop release member 80 is included and generally includes a first end 82 associated with one or more tear members 100 and a second end 84 configured to engage the stop member 70.

When the stop member 70 engages the second end 84 of the stop release member 80, rotation of the drive roller 60, drive wheel 52, and driven wheel 54 is stopped. Release of the stop member 70 from the second end 84 of the stop release member 80 allows for energy stored in the extension spring 64 to rotate the driven wheel 54 such that a portion of the sheet material 12 can be dispensed from the dispenser 10. The drive roller 60, drive wheel 52, and the driven wheel 54 are configured to rotate as material is withdrawn from the dispenser 10. For example, the drive roller 60 and the drive wheel 52 can be configured to complete one or more full rotations in order to dispense a desired amount of sheet material. The driven wheel 54 can be configured such that certain amounts of rotation correspond to a desired amount of sheet material.

Figure 2:
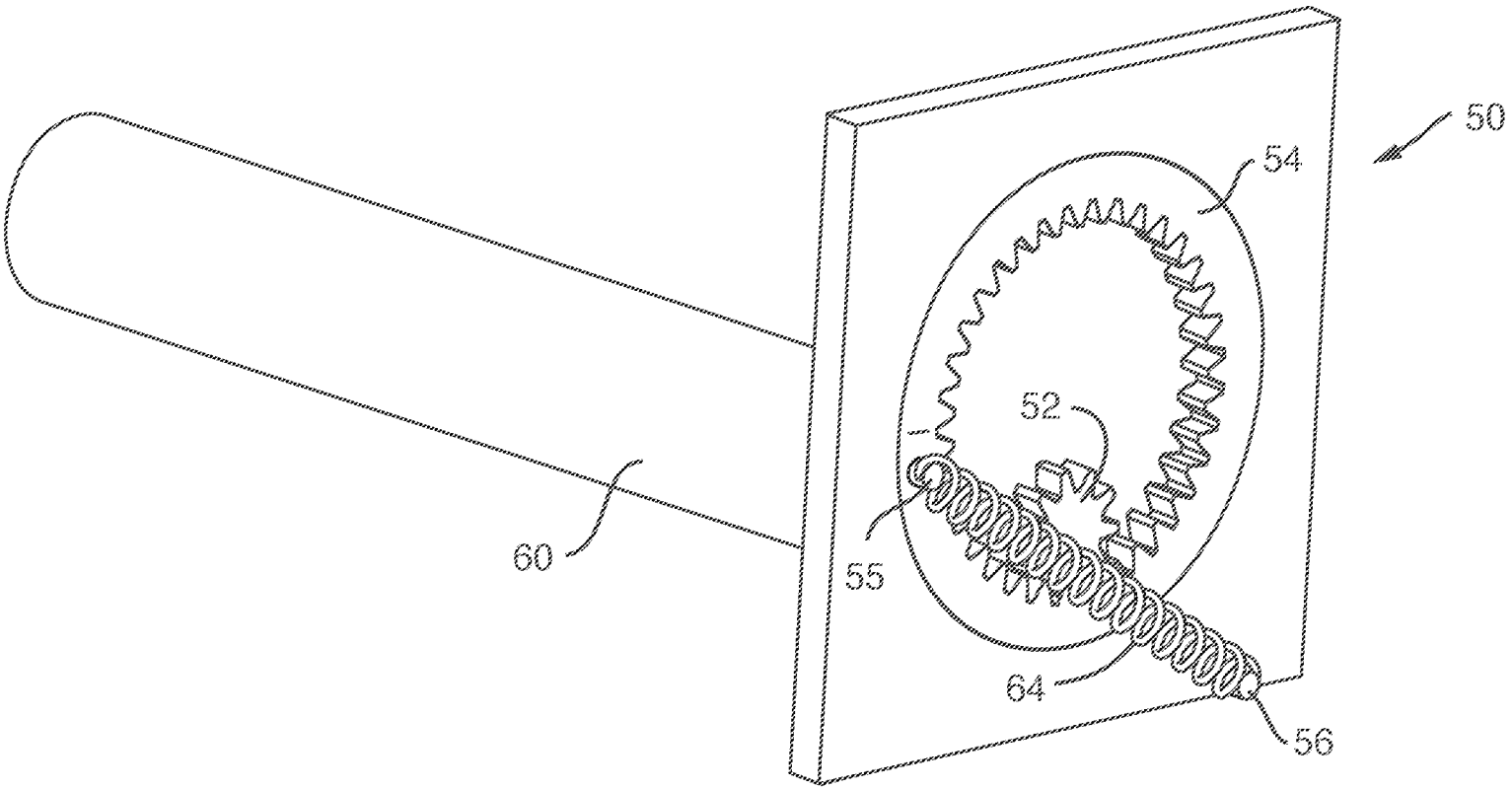
FIG. 2 is a perspective view of one embodiment of an indexing mechanism in accordance with the present disclosure.

As shown in FIG. 2, the indexing mechanism 50 can include a drive wheel 52 and a driven wheel 54. The drive wheel 52 and driven wheel 54 can be any suitable indexing mechanism. For example, in certain embodiments the drive wheel 52 can include a gear with one or more teeth. The driven wheel 54 can include a wheel having one or more teeth configured to engage the teeth of the drive wheel 52. The drive wheel 52 is configured to a drive roller 60. As shown, the drive wheel 52 has fewer teeth than the driven wheel 54. For example, the drive wheel 52 and the driven wheel 54 may have a gear teeth ratio of from about 1:2 to about 1:5 (drive wheel teeth:driven wheel teeth), such as about 1:3.5. In a specific embodiment, the drive wheel 52 includes a gear having ten teeth and the driven wheel 54 includes a gear having 35 teeth. In such an embodiment, the drive wheel 52 can be configured to rotate 3.5 rotations and the driven wheel 54 rotates 270° before the stop member 70 engages the second end 84 of the stop release member 80. Once the stop member 70 engages the second end 84 of the stop release member 80, rotation of the drive roller 60, drive wheel 52, and driven wheel 54 is stopped.

As shown in FIG. 2, the driven wheel 54 is configured such that one end of an extension spring 64 can be attached to the driven wheel 54. In some embodiments, the driven wheel 54 has a spring attachment mechanism 55 thereon. A second spring attachment mechanism 56 can be located on the housing 16 or on the wall of the module on which the driven wheel 54 is mounted. The extension spring 64 is positioned such that it is extended when the stop member 70 is engaged with the second end 84 of the stop release member 80. When the stop member 70 is released by the stop release member 80, energy stored in the extension spring 64 rotates the driven wheel 54, which, in turn, rotates the drive wheel 52 and the drive roller 60 to dispense a portion of sheet material 12. The extension spring 64 can be configured such that it is capable of rotating the driven wheel 54 by a specific amount. For example, rotating the driven wheel 54 90° can correspond to a selected amount of sheet material being dispensed. The extension spring 64 can be configured such that it is capable of rotating the driven wheel 54 a certain amount in order to dispense a desired amount of sheet material. In one embodiment, for example, each 90° rotation of the driven wheel 54 can correspond to a three-inch sheet of sheet material being dispensed. Accordingly, when the extension spring 64 rotates the driven wheel 90°, a three-inch tail is dispensed.

Figure 3:
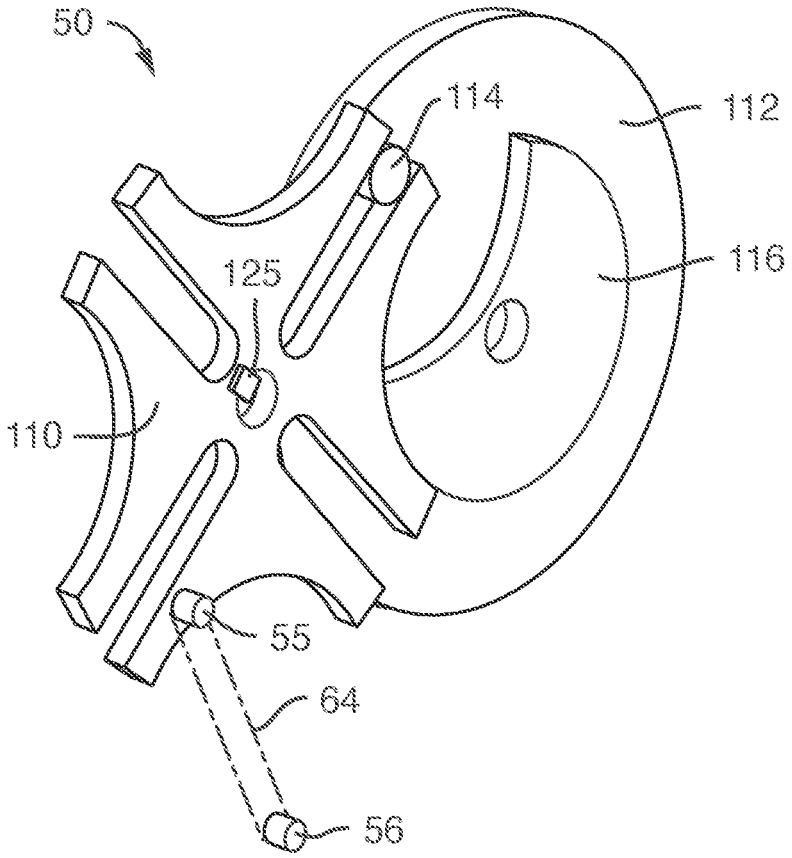
FIGS. 3 is a perspective view of one embodiment of a indexing mechanism in accordance with the present disclosure.
Figure 4B:
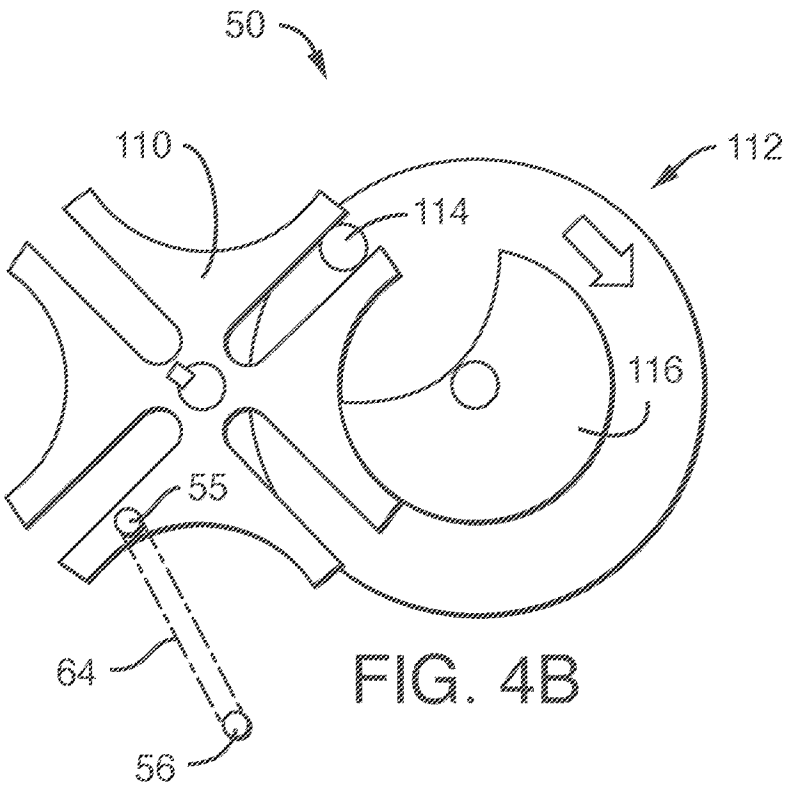
FIGS. 4A and 4B are plan views of one embodiment of a indexing mechanism in accordance with the present disclosure.
Figure 4A:
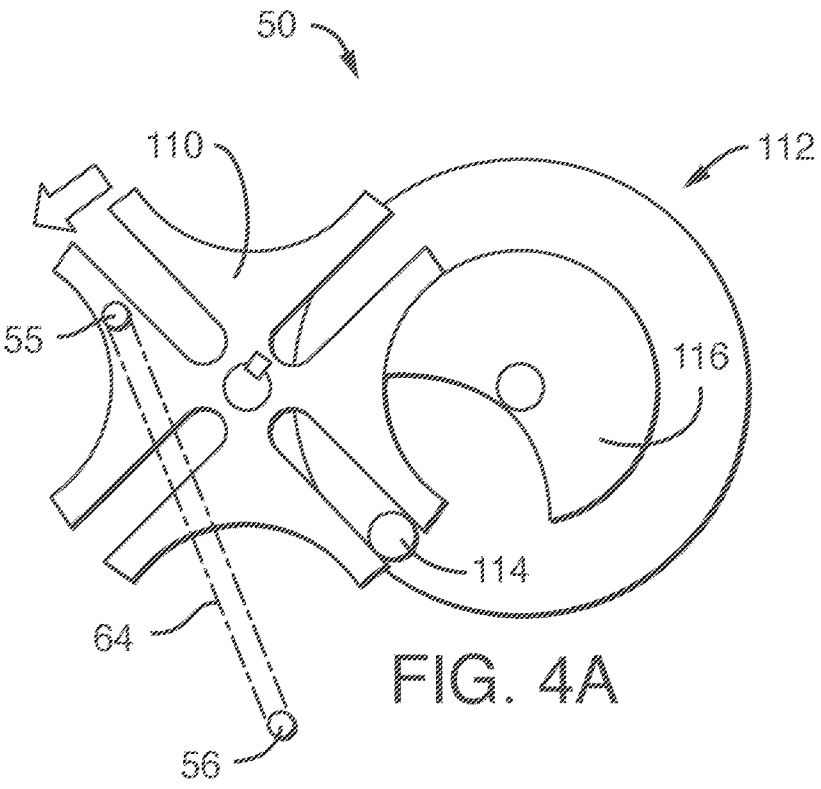

As shown in FIGS. 3, 4*a* and 4*b*, in some embodiments, the drive wheel 52 can include a driving cam wheel 112 and the driven wheel 54 includes a slotted Geneva wheel 110. The driving cam wheel 112 is configured such that it is engageable with the slotted Geneva wheel 110 to impart a stepwise rotation thereto. The driving cam wheel 112 can include a drive wheel pin 114 capable of engaging the slots of the Geneva wheel 110 and rotating the Geneva wheel 110 in a stepwise fashion. As shown, the Geneva wheel 110 includes four equi-angularly spaced slots, however, any number of slots may be provided. The driving cam wheel 112 can also include a raised locking ring 116 for holding the Geneva wheel 110 in place in between rotations. The driving cam wheel 112 is configured to the drive roller 60, such that as the user removes sheet material from the dispenser 10, the drive roller 60 rotates, which rotates the driving cam wheel 112. Accordingly, in this embodiment, drive roller 60 and the driving cam wheel 112 rotate in the same direction.

In embodiments where the Geneva wheel 110 includes four equi-angularly spaced slots, each full rotation of the driving cam wheel 112 rotates the slotted Geneva wheel 110 90°. The slotted Geneva wheel 110 can be configured such that each rotation of the Geneva wheel 110 corresponds to a certain amount of sheet material. For example, the dispenser 10 can be configured such that each 90° rotation of the slotted Geneva wheel 110 dispenses a three-inch sheet of sheet material. Accordingly, in some embodiments, as the user removes the sheet material from the dispenser 10, the slotted Geneva wheel 110 is capable of rotating 270° before the stop member 70 engages the stop release member 80.

Indeed, the driven wheel 54 can be configured such that a certain amount of rotation of the driven wheel 54 corresponds to the dispenser dispensing a desired amount of sheet material 12. While certain described embodiments reference a three-inch sheet of material, the dispenser provided herein is not so limited. For example, the size of the drive roller 60, drive wheel 52, and driven wheel 54 can be adjusted such that increased or lesser amounts of sheet material 12 are capable of being dispensed. For example, if a larger amount of sheet material is desired, the drive roller 60, drive wheel 52, and driven wheel 54 can be configured such that select amount of rotation of the driven wheel 54 dispenses at least a three-inch sheet of material, such as at least a four-inch sheet of material, such as at least a 5-inch sheet of material, etc.

In certain embodiments, the drive wheel 52, driven wheel 54, and the drive roller 60 all rotate in the same direction. For example, in embodiments, where the drive wheel 52 and driven wheel are teethed gears, both the drive wheel 52 and the driven wheel 54 can rotate in the same direction. In other embodiments, the drive wheel 52 may rotate in a different direction from the driven wheel 54, such as in an opposite direction. For example, in embodiments where the driven wheel 54 rotates in a clockwise motion the drive wheel 52, in turn, rotates in a counterclockwise motion.

Figure 6:
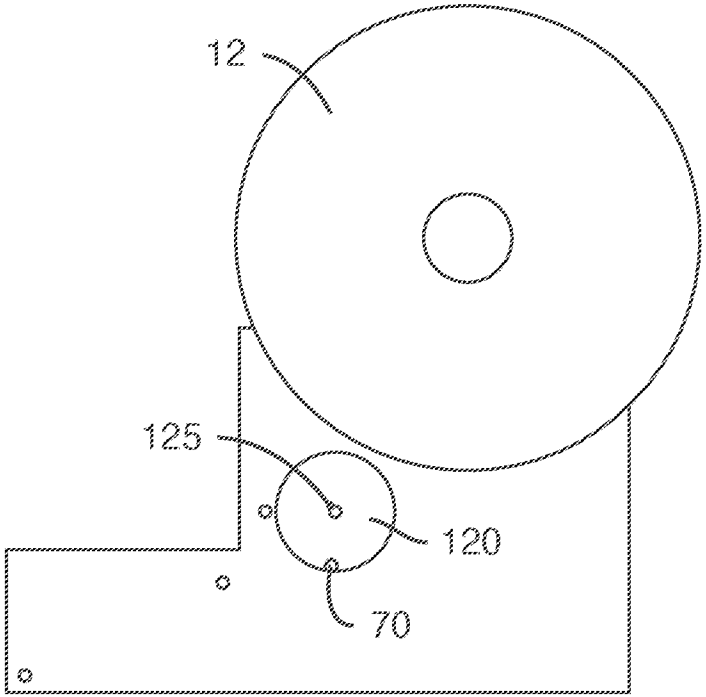
FIG. 6 is a plan view of one side of the dispenser in accordance with the present disclosure.
Figure 5:
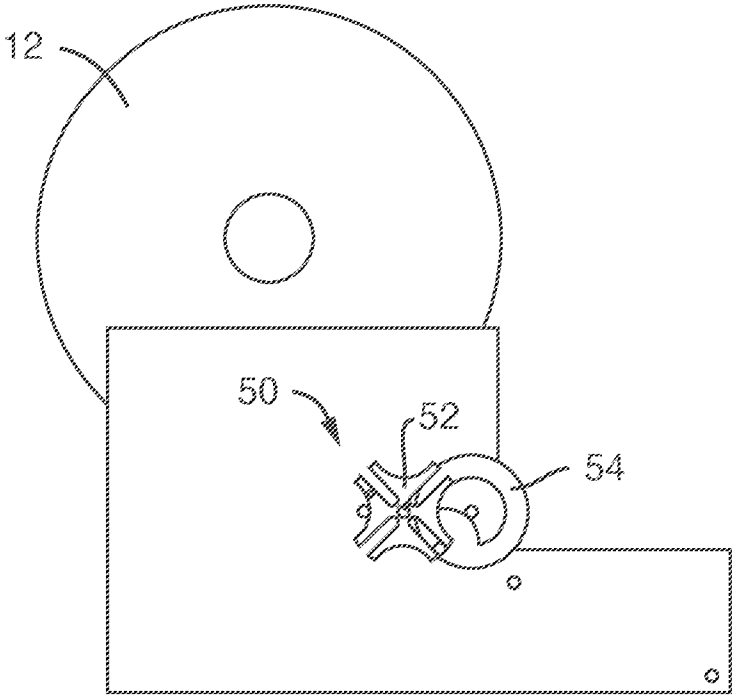
FIG. 5 is a plan view of one side of the dispenser in accordance with the present disclosure.
Figure 7:
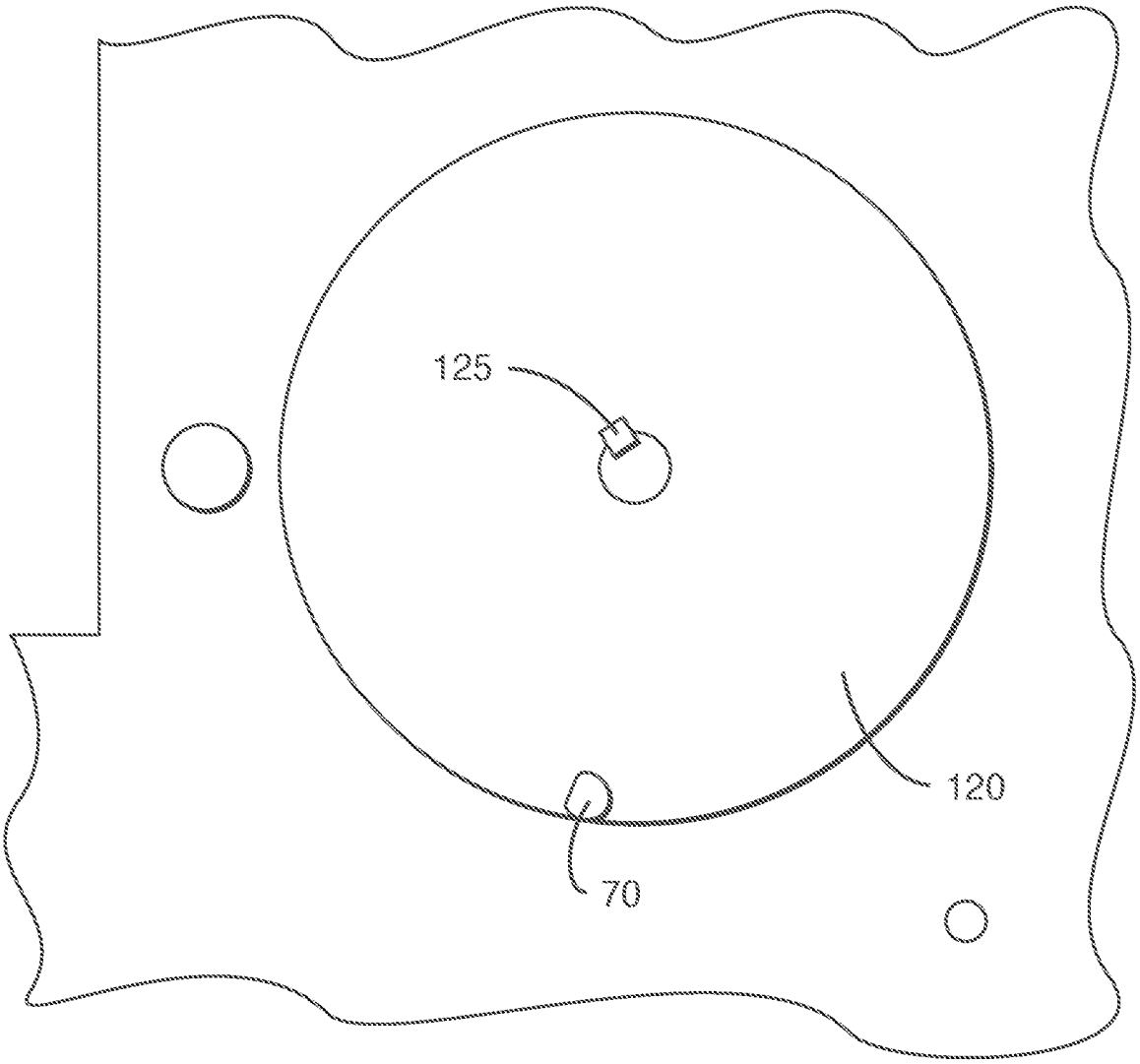
FIG. 7 is a plan view of one embodiment of the stop member in accordance with the present disclosure.
Figure 9:
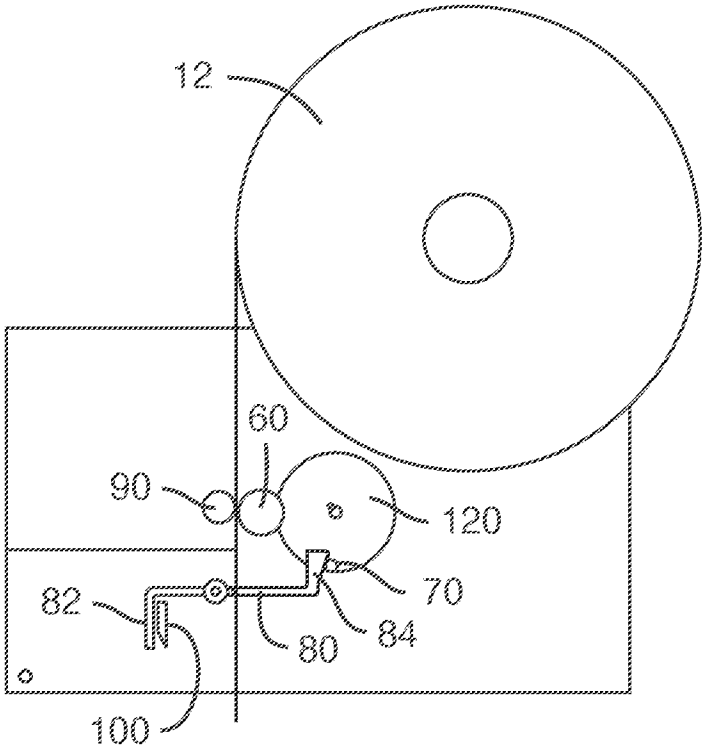
FIG. 9 is a plan view of one embodiment of the dispenser in accordance with the present disclosure.
Figure 8:
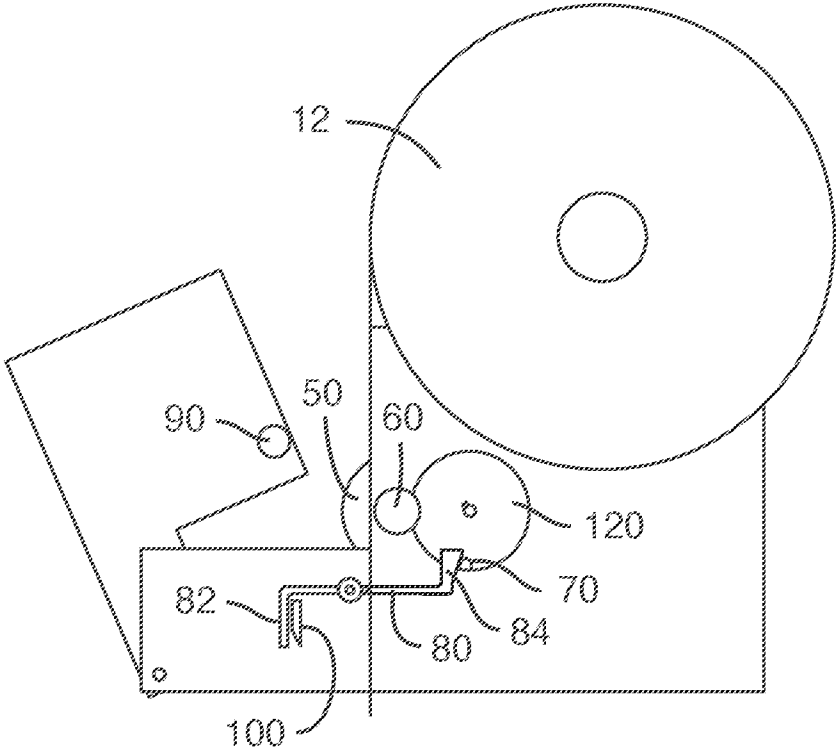
FIG. 8 is a plan view of one embodiment of the dispenser in accordance with the present disclosure.

Referring now to FIGS. 5-7 the drive wheel 52 and driven wheel 54 can be mounted to the sidewall 17 of the dispenser 10. Still in other embodiments, the drive wheel 52 and driven wheel 54 can be mounted to the sidewall of a module housed within the interior of the dispenser 10. A disk 120 can be mounted on the opposite side of the wall from the drive wheel 52 and the driven wheel 54. The stop member 70 can be configured to or attached to the disk 120. The disk 120 can be rigidly and rotationally affixed to the driven wheel 54 such that when the driven wheel 54 makes one rotation the disk 120, having the stop member 70 thereon, also makes one rotation. As the driven wheel 54 is indexed, the disk 120 having the stop member 70 thereon is indexed as well. In certain embodiments, the disk 120 can be affixed to the driven wheel 54 with a key 125. The disk 120 can be located on the interior of the housing 16 or the interior of the wall of an insert housing the dispensing mechanism, while the drive wheel and driven wheel can be mounted to the exterior of the side wall 17 of the housing 16 or the exterior of the insert.

As shown in FIGS. 8-12, the dispenser 10 includes roll of sheet material 12 and a pressure roller 90 configured to apply spring pressure against the sheet material 12 and the drive roller 60. The pressure roller 90 is spring biased against the drive roller 60 such that the sheet material 12 passing between the nip of the rollers is advanced along the dispensing path upon rotation of the drive roller 60. Rotation of the drive roller 60 rotates the drive wheel 52.

Figure 10:
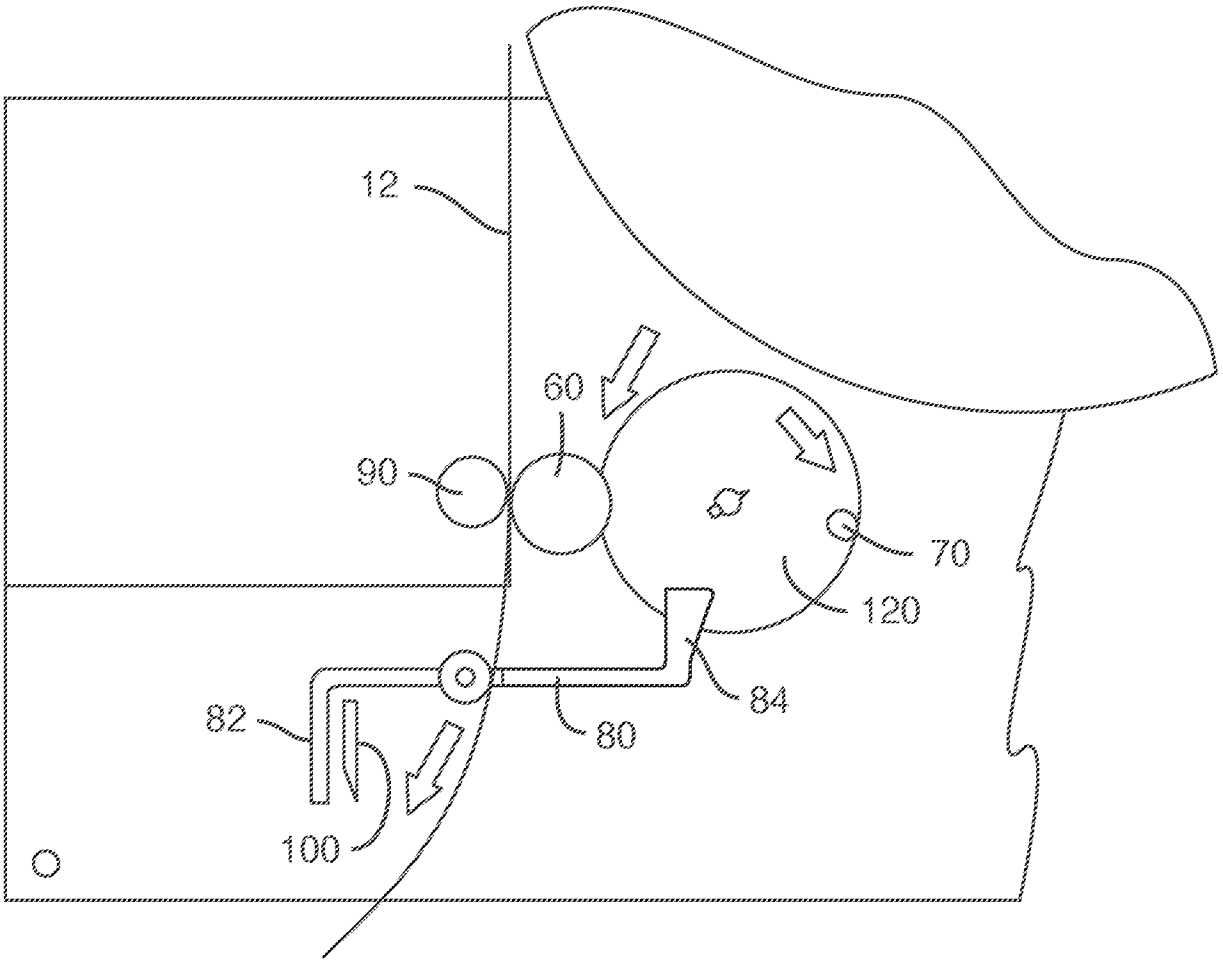
FIG. 10 is a plan view of one embodiment of the dispenser in accordance with the present disclosure.
Figure 11:
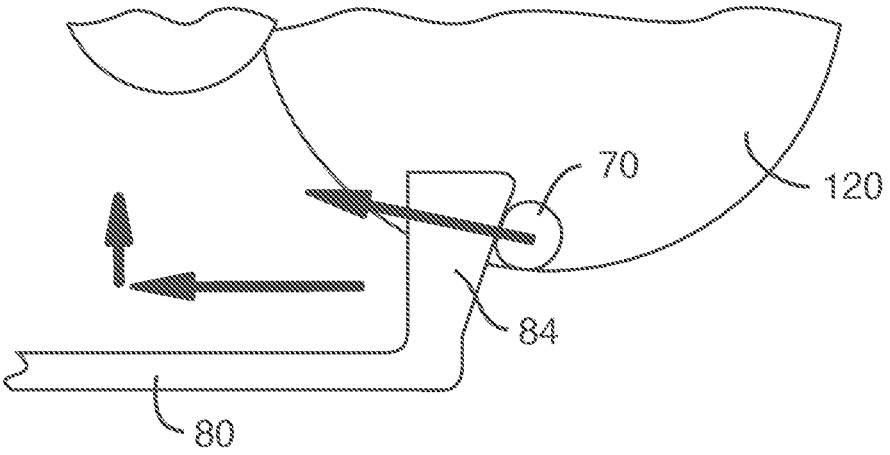
FIG. 11 is a plan view of one embodiment of the dispenser in accordance with the present disclosure.

As shown in FIG. 10, as the sheet material 12 is advanced along the dispensing path the drive roller 60 rotates thus rotating the drive wheel 52, which in turn rotates the driven wheel 54, which rotates the disk 120 and the stop member 70. Rotation of the drive roller 60 also rotates the drive wheel 52 and the driven wheel 54. In certain embodiments, after a certain amount of rotation of the disk, the stop member 70 will engage the second end 84 of the stop release member 80, thereby stopping the dispensing of the sheet material 12. The stop release member 80 is configured such that any vertical or horizontal force exerted by the stop member 70 when it contacts the stop release member 80 is absorbed by the stop release member 80 (as shown in FIG. 11). Further, additional stops or other members may be used such that any vertical force exerted by the stop member 70 on the stop release member 80 does not pivot the first end 84 in a downward motion. Accordingly, the stop release member 80 is configured such that dispensing of the sheet material 12 is stopped until the sheet material 12 is torn off from the roll.

Figure 12:
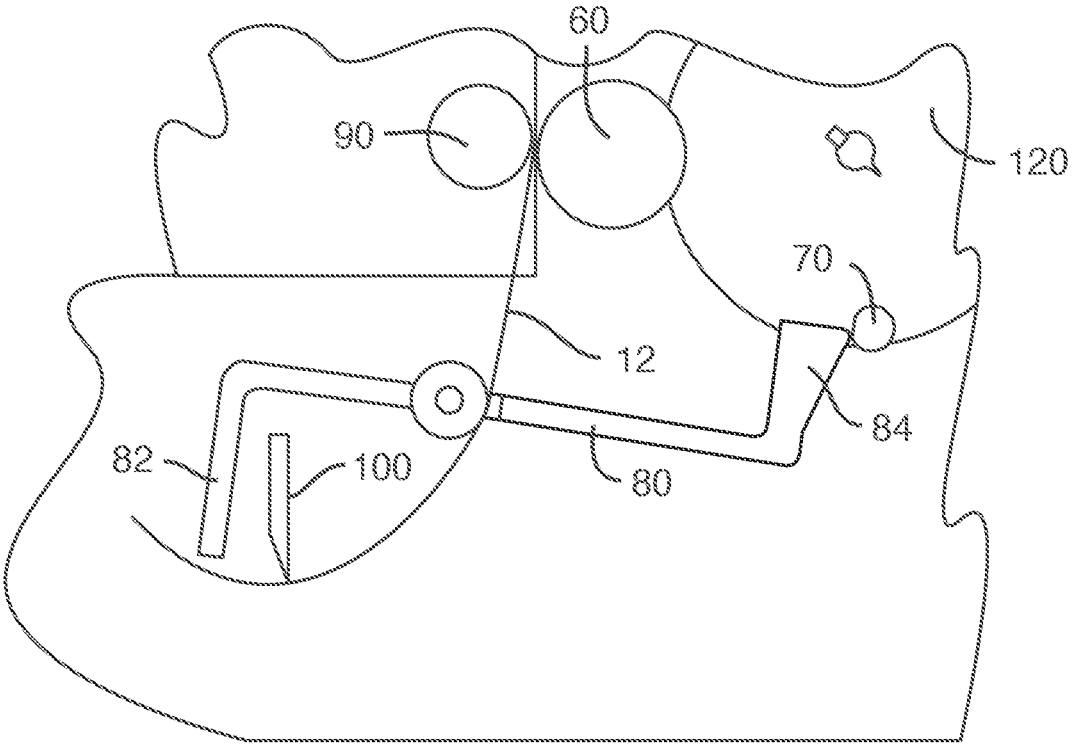
FIG. 12 is a plan view of one embodiment of the dispenser in accordance with the present disclosure.

Referring now to FIG. 12, when the sheet material 12 is biased against the one or more tear members 100 to tear the sheet material, the sheet material 12 moves the first end 82 of the stop release member 80 causing the stop release member 80 to pivot about the pivot point, which causes the second end 84 to disengage and release the stop member 70. For example, the first end 82 can be positioned with respect to the tear member 100, such that the sheet material 12 must come into contact with the first end 82 before the sheet material can access said tear member 100. For example, the first end 82 can include an arm that extends below the tear member 100, thus ensuring that the sheet material moves the arm of the first end in order to access the tear member 100.

Figure 13:
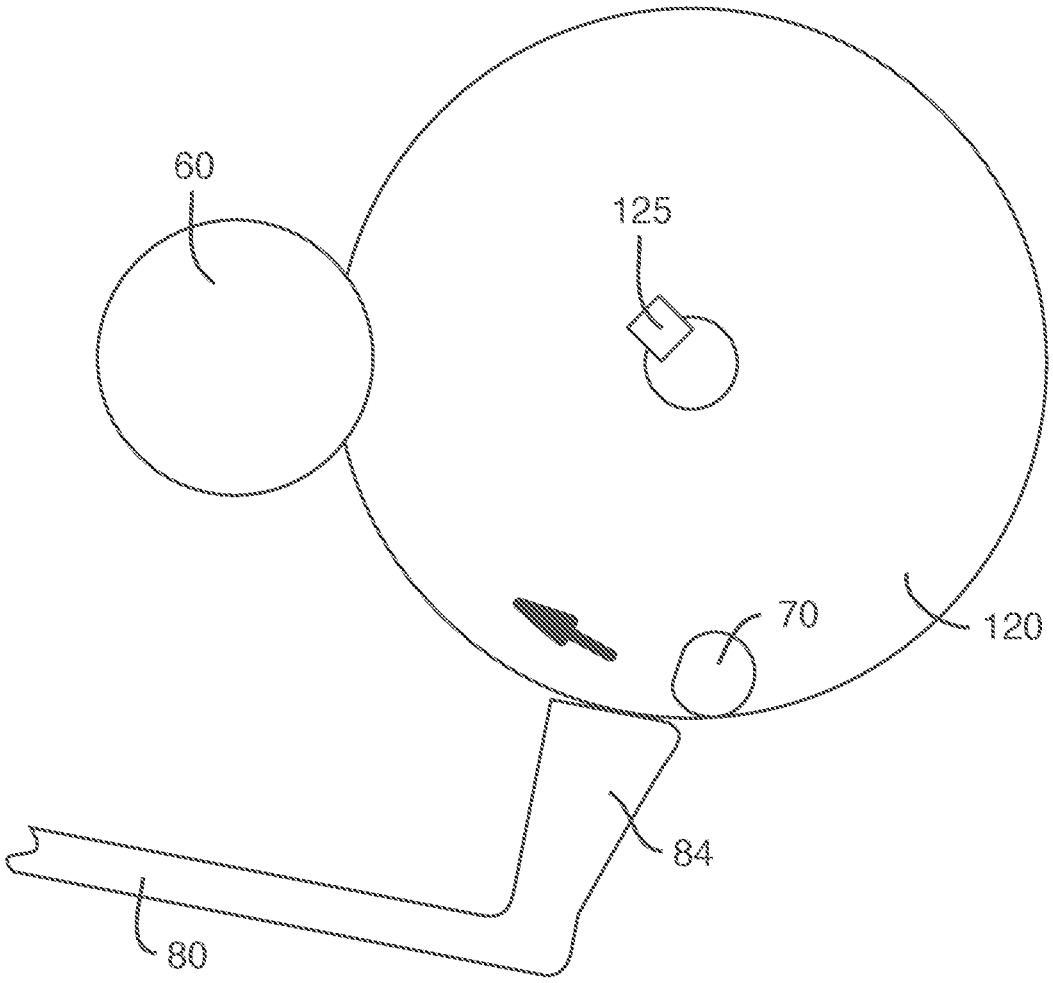
FIG. 13 is a plan view of one embodiment of the dispenser in accordance with the present disclosure.
Figure 14A:
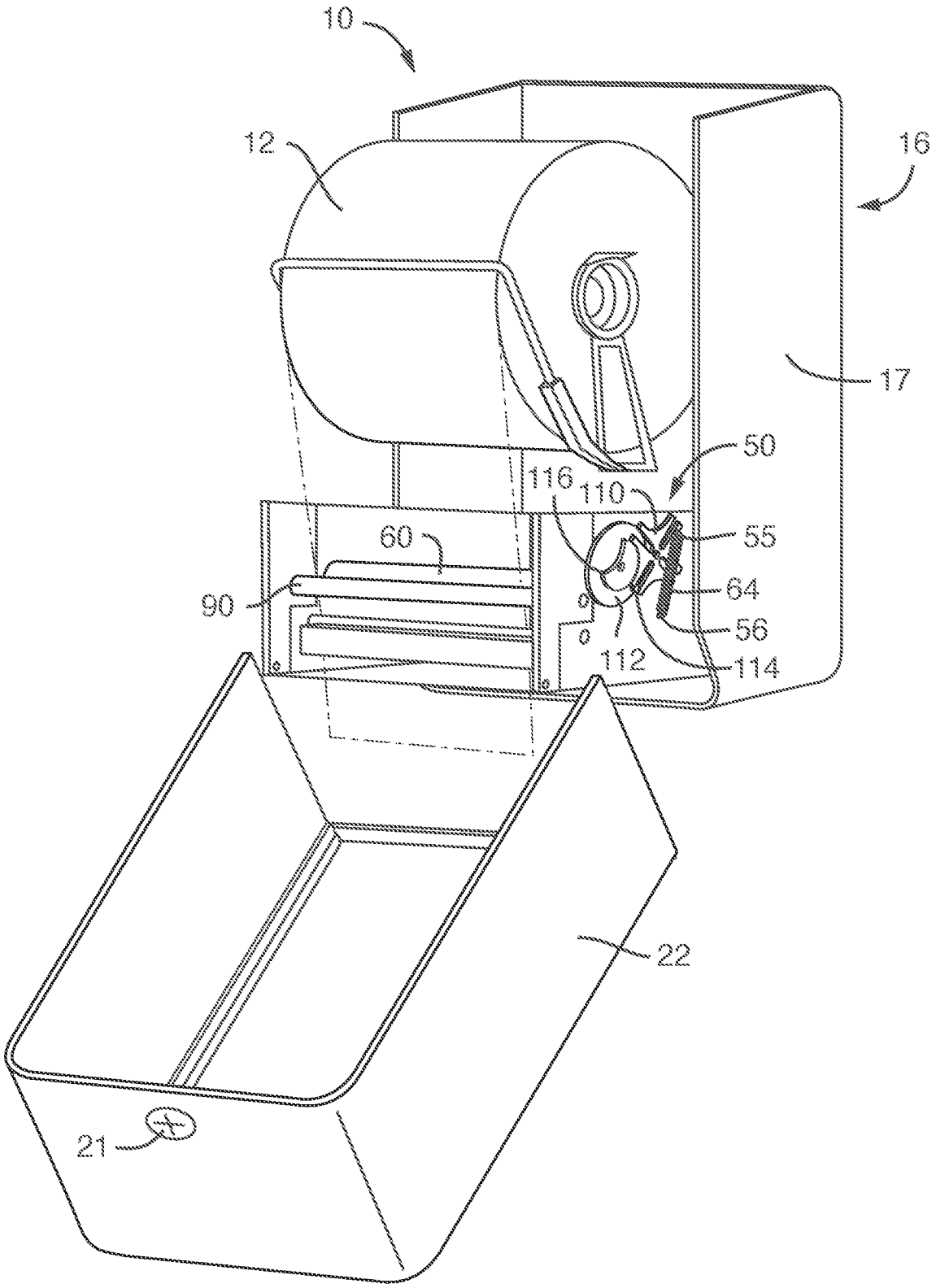
FIG. 14A is a perspective view of one embodiment of a dispenser in accordance with the present disclosure with its front cover in an open position.
Figure 14B:
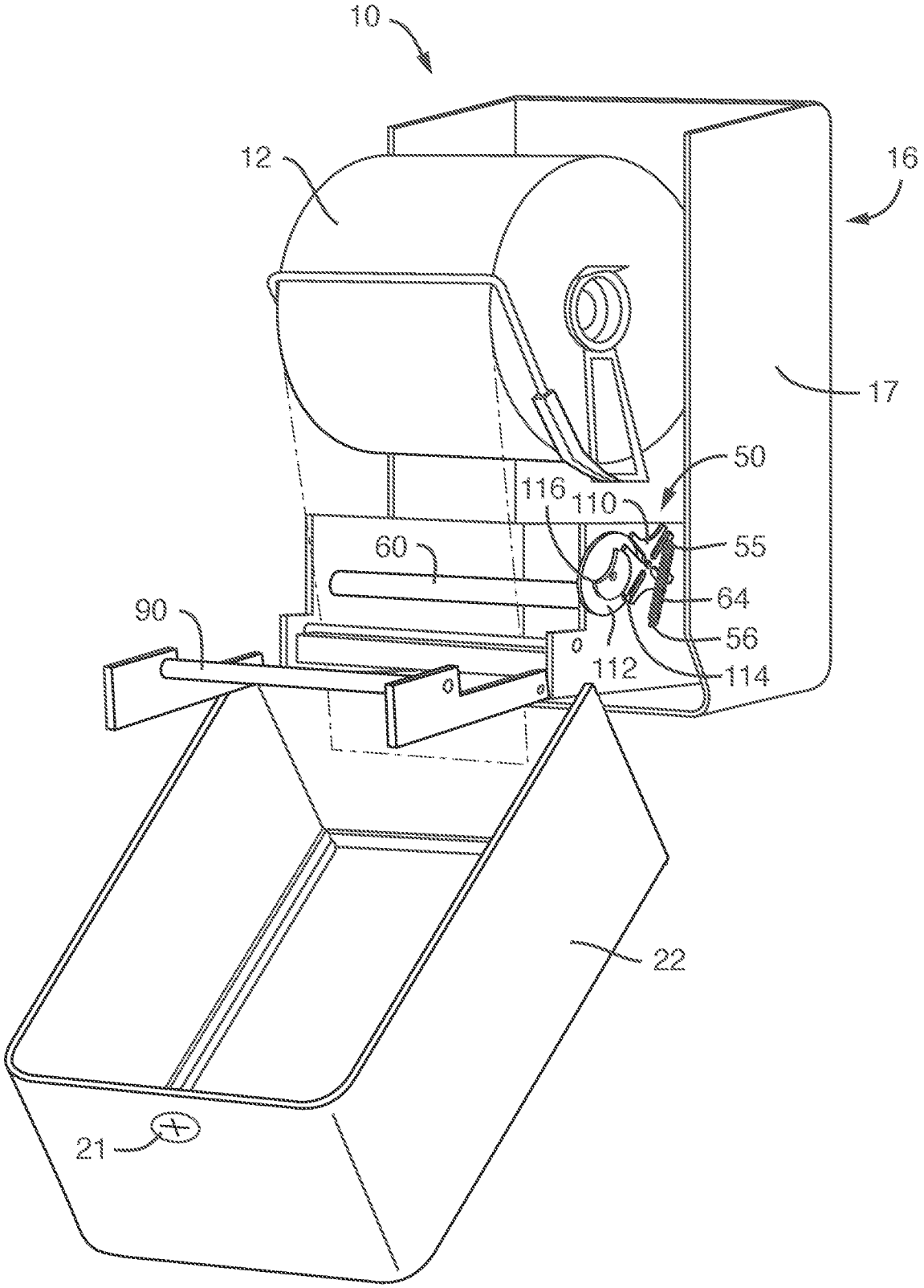
FIG. 14B is a perspective view of one embodiment of a dispenser in accordance with the present disclosure with its front cover in an open position.

As shown in FIG. 13, once the second end 84 of the stop release member 80 disengages the stop member 70, stored energy in the extension spring 64 is released and allows the driven wheel 54 to rotate a specific amount, thus dispensing a portion of sheet material 12. For example, energy stored in the extension spring 64 can rotate the driven wheel 54 90°, which in turn rotates the drive wheel 52 and the drive roller 60 in order to dispense the tail of sheet material for the next user.

Accordingly, the drive roller 60, drive wheel 52, and driven wheel 54 can each be configured such that a certain number of rotations of the drive roller 60 or drive wheel 52 correspond to a selected amount of sheet material 12. For example, in certain embodiments, the drive roller 60 and the drive wheel 52 are configured to complete one or more 360° rotations in order to dispense a desired amount of sheet material. In some embodiments, the drive wheel 52 and the drive roller 60 can be configured to rotate multiple 360° rotations in order to dispense the desired amount of product. In such embodiments, the circumference of the drive roller is smaller than the desired sheet length. For many manual dispensers, the circumference of the drive roller must be equal to the desired sheet length. For example, to dispense a twelve-inch sheet length from other dispensers, the drive roller would require a twelve-inch circumference. However, the drive roller 60 of the present dispenser 10 is capable of having a circumference that is smaller than the desired sheet length. The present drive roller 60 is configured to complete multiple 360° rotations to dispense the desired amount of sheet material. As such, the present drive roller 60 does not require a circumference that is equal to the desired sheet length. In certain embodiments, the drive roller 60 has a circumference of from about 2.5 inches to about 4 inches, such as about 3.4 inches, such as about 3.82 inches. In some embodiments, the drive roller 60 has a diameter of from about 0.5 inches to about 1.5 inches, such as about 0.80 inches, such as about 1.30 inches.

The dispenser 10 can be configured such that as the user grabs a tail of sheet material from the dispenser 10, the driven wheel 54 is capable of rotating a specific amount corresponding to a desired amount of sheet material before being stopped by the stop member 70. For example, in order to dispense a twelve-inch sheet of material 12, the driven wheel 54 can be configured such that each 90° rotation of the driven wheel 54 corresponds to a three-inch portion of sheet material 12. In such an embodiment, the user grabs a three-inch hanging tail of material and begins to remove the sheet material, which rotates the drive roller 60, thus turning both the drive wheel 52 and the driven wheel 54. The driven wheel 54 can rotate 270° to dispense a nine-inch portion of sheet material, which including the three-inch tail, equals a twelve-inch sheet.

Further, the drive wheel 52 and the drive roller 60 can be configured to complete one or more full rotations in order to dispense the desired amount of sheet material. For example, the drive wheel 52 and the drive roller 60 can complete two or more 360° rotations, such as three or more 360° rotations, such as four or more 360° rotations. Once the drive wheel 52 and the drive roller 60 have completed the desired amount of rotations corresponding to the selected amount of sheet material, the stop member 70 engages the second end 84 of the stop release member 80.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for sheet materials comprising:

a housing having an interior volume so as to retain at least one roll of sheet material, the housing including;

a dispensing mechanism contained within the housing for dispensing the sheet material;

wherein the dispensing mechanism comprises:

a drive roller configured to a drive wheel, wherein the drive wheel is configured to a driven wheel having an extension spring attached thereto; and a stop release member having a first end and a second end, wherein the second end of the stop release member is configured to engage a stop member configured to the driven wheel, such that rotation of the drive roller, drive wheel, and driven wheel is stopped upon the stop member engaging the second end of the stop release member, wherein tearing the sheet material moves the second end of the stop release member out of engagement with the stop member allowing for stored energy in the extension spring to rotate the drive roller via the driven wheel and drive wheel to dispense a tail of the sheet material.

2. The dispenser of claim 1, wherein driven wheel is rotated 270° before the stop member engages the second end of the stop release member.

3. The dispenser of claim 1, wherein the stored energy in the extension spring rotates the driven wheel 90° to dispense the tail of the sheet material.

4. The dispenser of claim 1, wherein the drive wheel is configured to rotate in the same direction as the drive roller.

5. The dispenser of claim 1, wherein the driven wheel is configured to rotate in the same direction as the drive roller.

6. The dispenser of claim 1, wherein the driven wheel is configured to rotate in a different direction from the drive roller.

7. The dispenser of claim 1, wherein the drive wheel comprises a gear having one or more teeth.

8. The dispenser of claim 1, wherein the driven wheel comprises a gear wheel having one or more teeth.

9. The dispenser of claim 1, wherein the driven wheel includes a slotted Geneva wheel and the drive wheel includes a driving cam wheel engageable with the slotted Geneva wheel to impart a stepwise rotation thereto.

10. The dispenser of claim 9, wherein the slotted Geneva wheel comprises four slots.

11. The dispenser of claim 1, wherein the drive roller has a circumference of from about 2.5 inches to about 4 inches.

12. The dispenser of claim 1, comprising an opening configured to allow a user to access the sheet material.

13. The dispenser of claim 12, wherein the opening is configured with one or more tear members.

14. The dispenser of claim 13, wherein the first end of the stop release member is configured such that in order for the sheet material to access the one or more tear members the sheet material comes in to contact with the first end of the stop release member causing the stop release member to pivot about a pivot point such that the second end of the stop release member disengages from the stop member.

15. The dispenser of claim 1, wherein the stop member is configured to a disk that is configured to the driven wheel.

16. The dispenser of claim 1, comprising a pressure roller configured to the drive roller, wherein a dispensing path is formed between the drive roller and the pressure roller.

17. The dispenser of claim 16, wherein the drive roller is rotated by the sheet material as the sheet material is dispensed along the dispensing path.

18. The dispenser of claim 1, wherein the roll of sheet material comprises a roll of paper towels for dispensing paper towels from the dispenser.

19. A method of dispensing a sheet material using the dispenser of claim 1, the method comprising:

tearing the sheet material by a user, wherein tearing the sheet material moves the first end of the stop release member such that the second end of the stop release member disengages the stop member; and moving the dispensing mechanism and the drive roller with the stored energy in the extension spring such that a portion of sheet material can be dispensed.

20. A dispenser for sheet materials comprising:

a housing having an interior volume so as to retain at least one roll of sheet material, the housing including;

a dispensing mechanism contained within the housing for dispensing the sheet material;

wherein the dispensing mechanism comprises:

a drive roller configured to an indexing mechanism, wherein the indexing mechanism has an extension spring configured thereto; and a stop release member having a first end and a second end, wherein the second end of the stop release member is configured to engage a stop member configured to the indexing mechanism, such that rotation of the drive roller and indexing mechanism is stopped upon the stop member engaging the second end of the stop release member, wherein tearing the sheet material moves the second end of the pivoting stop member out of engagement with the stop release member allowing for stored energy in the extension spring to rotate the drive roller via the indexing mechanism to dispense a tail of the sheet material.

* * * * *